US005099506A

United States Patent [19]

Van Der Kooi et al.

[11] Patent Number: 5,099,506

[45] Date of Patent: Mar. 24, 1992

[54] X-RAY ROTARY ANODE

[75] Inventors: Gerhard J. Van Der Kooi; Bernard J. P. Van Rheenen; Herman W. Pietersma, all of Eindhoven, Netherlands

[73] Assignee: U.S. Philips Corporation, New York, N.Y.

[21] Appl. No.: 638,256

[22] Filed: Jan. 4, 1991

[30] Foreign Application Priority Data

Jan. 10, 1990 [NL] Netherlands ..... 9000061

[51] Int. Cl.[5] ..... H01J 35/10

[52] U.S. Cl. ..... 378/144; 378/125; 378/143

[58] Field of Search ..... 378/121, 125, 127, 128, 378/129, 143, 144

[56] References Cited

U.S. PATENT DOCUMENTS

| | | | |
|---|---|---|---|
| H547 | 11/1988 | Lux et al. | 378/144 |
| Re. 31,560 | 4/1984 | Devine, Jr. | 378/144 |
| 4,939,762 | 7/1990 | Baba et al. | 378/144 |
| 4,972,449 | 11/1990 | Upadhya et al. | 378/144 |
| 5,031,201 | 7/1991 | Gaillard et al. | 378/144 |

FOREIGN PATENT DOCUMENTS

| | | |
|---|---|---|
| 2242775 | 8/1973 | France . |
| 2593325 | 1/1986 | France . |

*Primary Examiner*—Janice A. Howell
*Assistant Examiner*—David P. Porta
*Attorney, Agent, or Firm*—William Squire

[57] ABSTRACT

An X-ray rotary anode (1) comprising a graphite carrier body (3) and a tungsten target layer (11) can withstand a high-temperature load when an intermediate layer is provided which is composed of a layer of silicon carbide (7) and a layer of titanium nitride (9).

20 Claims, 1 Drawing Sheet

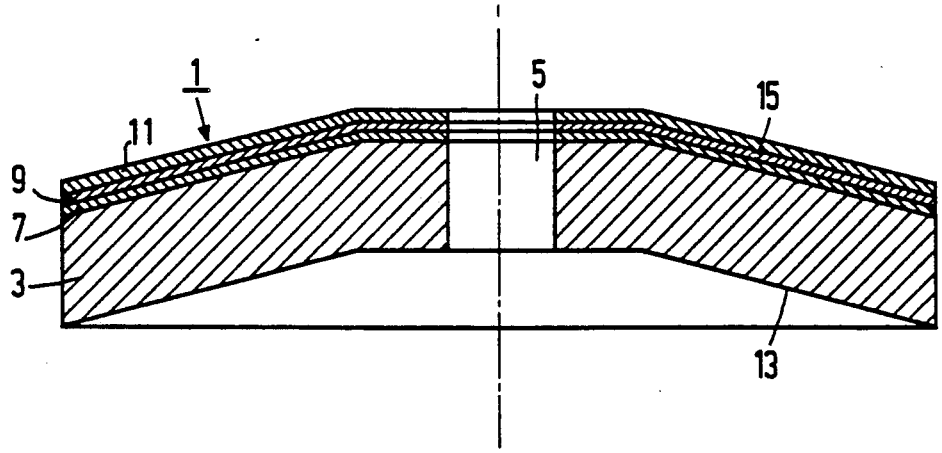
1
5
15
11
9
7
3
13

X-RAY ROTARY ANODE

BACKGROUND OF THE INVENTION

The invention relates to an X-ray rotary anode comprising a carrier body of graphite and a target layer of tungsten or a tungsten alloy, a silicon-carbide layer being present between the carrier body and the target layer.

Such X-ray rotary anodes are used in X-ray tubes, in particular X-ray tubes for medical purposes. In the X-ray tubes, electrons of high energy originating from a cathode are launched onto the target layer of the rotary anode. When the electrons reach the target layer only a small part of the energy is released in the form of X-rays; the greater part (approximately 99%) is converted into heat. Since there is a vacuum in the X-ray tube, the dissipation of heat takes place mainly by radiation. Graphite is a material having a high heat-emission coefficient. Moreover, its specific mass is low relative to other customary carrier materials such as Mo or Mo-containing alloys. A low specific mass enables a high speed of the rotary anode, thus permitting an increase of the thermal load.

An X-ray rotary anode of the type mentioned in the opening paragraph is known from French Patent Application FR 2593325. The X-ray rotary anode described in this document comprises a carrier body of graphite, a target layer of tungsten or a tungsten alloy and an intermediate layer of, for example, rhenium or silicon carbide. Such intermediate layers enhance the adhesion between the target layer and the carrier body and reduce the diffusion of carbon from the graphite to the tungsten layer.

To increase the emission of heat by thermal radiation it is desirable to increase the operating temperature of the X-ray rotary anode from, at present, approximately 1400° C. to approximately 1600° C. Since the radiation energy delivered is proportional to the fourth power of the absolute temperature of a radiating body, the increase in temperature means that the output of thermal radiation energy is doubled. A disadvantage of the known X-ray rotary anode is that at such high operating temperatures carbon originating from the silicon carbide intermediate layer diffuses to the tungsten layer and forms tungsten carbides. At such high operating temperatures, a rhenium intermediate layer does not sufficiently preclude the diffusion of carbon from the graphite carrier body to the tungsten layer, so that tungsten carbides are still formed. Such tungsten carbides are brittle and cause mechanical stresses between the intermediate layer and the tungsten target layer. Delamination between the tungsten target layer and the intermediate layer takes place owing to large variations in temperature, thereby causing the target layer to insufficiently contact the graphite carrier body through the intermediate layer. The temperature of the target layer then rises in an uncontrolled manner, as a result of which the target layer becomes integrally detached and/or melts.

SUMMARY OF THE INVENTION

One of the objects of the invention is to provide an X-ray rotary anode of the type described in the opening paragraph, in which the above-mentioned disadvantage is overcome.

For this purpose, an X-ray rotary anode according to the invention is characterized in that a titanium-nitride layer is interposed between the silicon-carbide layer and the target layer. The titanium-nitride layer serves as a diffusion-barrier layer for the carbon from the silicon-carbide layer. The use of a titanium-nitride layer insufficiently precludes the diffusion of carbon originating from the graphite carrier body when the silicon-carbide layer is omitted. The combination of a double intermediate layer of silicon carbide and titanium nitride enables a lengthy temperature load at minimally 1600° C. without demonstrable carbon diffusion.

A suitable embodiment of the X-ray rotary anode according to the invention is characterized in that the titanium-nitride layer has a thickness between 2 and 20 μm. At a thickness below 2 μm, carbon diffusion is insufficiently precluded, whereas above a thickness of 20 μm the heat conduction of the layer deteriorates noticeably. A suitable layer thickness is approximately 4 μm. The titanium-nitride layer is preferably provided by "chemical vapour deposition" (CVD) by a reaction of, for example, $TiCl_4$ and $N_2$, but it can also be obtained by means of sputtering or reactive sputtering.

Another embodiment of the X-ray rotary anode according to the invention is characterized in that the silicon-carbide layer has a thickness between 20 and 150 μm. Below a thickness of 20 μm the diffusion of carbon from the graphite carrier body is insufficiently precluded, whereas at a thickness above 150 μm the heat conduction of the layer deteriorates noticeably and the brittleness increases. A suitable layer thickness is approximately 60 μm. The silicon-carbide layer can be advantageously provided by means of CVD by a reaction of, for example, an alkyl chlorosilane and $H_2$. A suitable silane is, for example, dimethyl dichlorosilane.

The target layer of the X-ray rotary anode according to the invention consists of tungsten or a tungsten alloy. All alloys known for this purpose yielded suitable results. Particularly satisfactory results are obtained with tungsten-rhenium alloys (0–10 at. % of rhenium). The target layer can be provided by means of thermal spraying such as plasma spraying, arc spraying, flame powder spraying and flame wire spraying, but preferably CVD is used. A tungsten layer can be provided by a reaction of $WF_6$ with $H_2$, the addition of $ReF_6$ to the reaction mixture leading to the formation of a tungsten-rhenium alloy.

BRIEF DESCRIPTION OF THE DRAWING

The invention will be explained in greater detail by means of the following exemplary embodiment and with reference to the accompanying drawing, which is a diagrammatic sectional view of an X-ray rotary anode according to the invention after it has been subjected to mechanical operations.

DESCRIPTION OF THE PREFERRED EMBODIMENT

In the accompanying drawing, reference numeral 1 represents a diagrammatic sectional view of an X-ray rotary anode according to the invention. A graphite carrier body consisting of a graphite disc 3 having a diameter of 90 mm is ultrasonically purified in distilled water and subsequently in isopropanol. Next, the disc is annealed in a vacuum at a temperature of 1000° C. for 1 hour. A silicon-carbide layer 7 having a thickness of 60 μm is provided in a "hot-wall" reactor by means of CVD. The reaction takes place at a pressure of 1 atmosphere and a temperature of 1200° C., a mixture of $H_2$ and 10 vol. % of dimethyl dichlorosilane being introduced into the reactor. The deposition rate of the silicon-carbide layer is approximately 15 μm per hour. Subsequently, the disc is ultrasonically purified in dichlorodifluoroethane at room temperature.

Next, a titanium-nitride layer 9 having a thickness of 4 μm is provided in a "hot-wall" reactor by means of CVD. The reaction takes place at a pressure of 1 atmosphere and a temperature of 900° C. The reaction mixture consists of $H_2$, 2 vol. % of $TiCl_4$ and 20 vol. % of $N_2$. The deposition rate of the titanium-nitride layer is approximately 1 μm per hour.

In a "hot-wall" reactor a 700 μm thick layer 11 of a tungsten-rhenium alloy is provided on the titanium-nitride layer 9. The reaction takes place at a pressure of 10 mbar and a temperature of 850° C. 1000 sccm of $H_2$, 100 sccm of $WF_6$ and 10 sccm of $ReF_6$ are introduced into the reactor space. The deposition rate of the tungsten-rhenium layer is 100 μm per hour. In this operation only side 15 of the disc is coated. The tungsten layer obtained contains 10 at. % of Re.

The disc is provided with a cylindrical central aperture 5 for accommodating a shaft which is not shown. The W—Re layer 11 is polished to a thickness of 500 μm by means of silicon carbide. The bottom side 13 of the disc also contains layers of silicon carbide and titanium nitride (not shown). These layers are ground away down to the graphite by means of a grinding disc provided with diamond, so that the bottom side 13 has a graphite surface.

The X-ray anode 1 thus treated is ultrasonically purified in distilled water and subsequently in isopropanol. The X-ray anode is then fired in a vacuum at 1000° C. for 1 hour.

The X-ray anode according to the invention is fired in a vacuum at 1600° C. for 6 hours. A metallographic section of the X-ray anode is made, which section is subjected to a microscopic examination. No carbides are detected at the interface between titanium nitride and tungsten. No signs of detachment are observed in the laminar structure.

COMPARATIVE EXAMPLE 1

By way of comparative example, an X-ray anode is manufactured according to the above method, with this difference that in this case one intermediate layer of silicon carbide having a thickness of 60 μm is used. After a temperature treatment in a vacuum at 1600° C. for 6 hours tungsten carbides are observed along the interface of silicon carbide and tungsten.

COMPARATIVE EXAMPLE 2

Comparative example 1 is repeated, using one intermediate layer of titanium nitride having a thickness of 10 μm. The temperature treatment yields tungsten carbides along the interface of titanium nitride and tungsten.

COMPARATIVE EXAMPLE 3

Comparative example 1 is repeated, using one intermediate layer of rhenium having a thickness of 10 μm. The temperature treatment yields tungsten carbides along the interface of rhenium and tungsten.

The comparative examples show that an intermediate layer of silicon carbide, titanium nitride or rhenium does not preclude the formation of carbides. An intermediate layer which is composed of silicon carbide and titanium nitride is an excellent diffusion barrier for carbon and precludes the formation of carbides to a sufficient degree.

What is claimed is:

1. An X-ray rotary anode comprising a carrier body of graphite, a target layer of tungsten, a silicon-carbide layer between the carrier body and the target layer, and a titanium-nitride layer between the silicon-carbide layer and the target layer.

2. An X-ray rotary anode as claimed in claim 1 wherein the titanium-nitride layer has a thickness between 2 and 20 μm.

3. An X-ray rotary anode as claimed in claim 1 wherein the silicon-carbide layer has a thickness between 20 and 150 μm.

4. An X-ray rotary anode as claimed in claim 1 wherein the target layer contains 0–10 at. % of rhenium.

5. An X-ray rotary anode as claimed in claim 1 wherein the silicon-carbide, titanium-nitride and target layers are provided by CVD.

6. An X-ray rotary anode as claimed in claim 2 wherein the silicon-carbide layer has a thickness between 20 and 150 μm.

7. An X-ray rotary anode as claimed in claim 2 wherein the target layer contains 0–10 at. % of rhenium.

8. An X-ray rotary anode as claimed in claim 3 wherein the target layer contains 0–10 at. % of rhenium.

9. An X-ray rotary anode as claimed in claim 2 wherein the silicon-carbide, titanium-nitride and target layers are deposited by chemical vapor deposition (CVD).

10. An X-ray rotary anode as claimed in claim 3 wherein the silicon-carbide, titanium-nitride and target layers are deposited by chemical vapor deposition (CVD).

11. An X-ray rotary anode as claimed in claim 4 wherein the silicon-carbide, titanium-nitride and target layers are deposited by chemical vapor deposition (CVD).

12. An X-ray rotary anode comprising a carrier body of graphite, a target layer of tungsten alloy, a silicon-carbide layer between the carrier body and the target layer, and a titanium-nitride layer between the silicon-carbide layer and the target layer.

13. An X-ray rotary anode as claimed in claim 12 wherein the titanium-nitride layer has a thickness between 2 and 20 μm.

14. An X-ray rotary anode as claimed in claim 12 wherein the silicon-carbide layer has a thickness between 20 and 150 μm.

15. An X-ray rotary anode as claimed in claim 12 wherein the target layer contains 0–10 at. % of rhenium.

16. An X-ray rotary anode as claimed in claim 12 wherein the silicon-carbide, titanium-nitride and target layers are deposited by chemical vapor deposition (CVD).

17. An X-ray rotary anode as claimed in claim 13 wherein the target layer contains 0–10 at. % of rhenium.

18. An X-ray rotary anode as claimed in claim 14 wherein the target layer contains 0–10 at. % of rhenium.

19. An X-ray rotary anode as claimed in claim 13 wherein the silicon-carbide, titanium-nitride and target layers are deposited by chemical vapor deposition (CVD).

20. An X-ray rotary anode as claimed in claim 18 wherein the silicon-carbide, titanium-nitride and target layers are deposited by chemical vapor deposition (CVD).

* * * * *